US006752185B1

(12) United States Patent
Blaylock et al.

(10) Patent No.: US 6,752,185 B1
(45) Date of Patent: Jun. 22, 2004

(54) LOG DEBARKER WITH COVERED BARK SLOTS

(75) Inventors: Dan E. Blaylock, Russelville, AL (US); James G. Miranda, Birmingham, AL (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/383,010

(22) Filed: Mar. 6, 2003

(51) Int. Cl.[7] ..... B27L 1/04
(52) U.S. Cl. ..... 144/208.9
(58) Field of Search ..... 144/208.1, 208.4, 144/208.5, 208.9, 2.1; 241/154, 153

(56) References Cited

U.S. PATENT DOCUMENTS

| | | | | |
|---|---|---|---|---|
| 3,086,569 A | | 4/1963 | Sandison | |
| 3,258,043 A | | 6/1966 | Dick | |
| 3,286,747 A | | 11/1966 | Delcellier | |
| 4,173,239 A | | 11/1979 | Reiche | |
| 4,262,715 A | * | 4/1981 | Häusler et al. | 144/208.9 |
| 4,596,280 A | * | 6/1986 | Svensson et al. | 144/208.9 |

OTHER PUBLICATIONS

"Rubber Tire Barking Drum", Metso Paper brochure 2002.

"Sketch of Bark Slot Covers", Metso Paper USA—Woodhandling Division.

* cited by examiner

*Primary Examiner*—Allen Ostrager
*Assistant Examiner*—Shelley Self
(74) *Attorney, Agent, or Firm*—Stiennon & Stiennon

(57) ABSTRACT

A debarking drum has a cylindrical steel shell mounted for rotation about the drum axis. The drum receives logs fed into one end and is rotated such that the tumbling action of the logs against one another within the drum causes the bark to be removed, and the debarked logs to be discharged at an outlet end of the drum. The cylindrical shell of the drum is penetrated by a multiplicity of slots at least some of which are larger than normal having a minimum width of 3½ inches, preferably 6 inches, and a length of about one to two feet. The slots are arrayed circumferentially about the drum and axially along the length of the drum. Each of the larger slots has a cover which is mounted to the exterior of the drum and is spaced to form a minimum gap between the exterior surface of the drum and the cover of two inches.

12 Claims, 3 Drawing Sheets

LOG DEBARKER WITH COVERED BARK SLOTS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to drum debarkers which are used to remove the bark from logs which are further processed, for example by being converted to wood chips.

Bark contains little cellulosic fiber and typically contains dark pigments. Therefore bark is viewed as an undesirable contaminant in wood fibers which are used to make paper or in wood chips which are used to make engineered wood products such as chipboard. Debarking drums have been developed to efficiently remove the bark from large quantities of raw logs without damaging or removing useful fiber. A debarking drum has a large cylindrical shell which is mounted on truck tires which are driven to cause the drum to rotate about the drum axis. Alternatively, the drum may be supported and driven by other support systems such as chains, or gears mounted to the exterior of the drum. Logs are placed into the drum debarker at one end and debarked logs are removed from the other end.

The diameter of a debarker drum shell ranges from nine feet to more than 16 feet. The drum is constructed with a steel shell sometimes having a thickness of an inch or more. The drum length may be from about 60 feet to more than 110 feet long, depending on how long it is desirable to retain the logs, and the length of the logs. Log length is typically in the range of six to 65 feet. The logs are fed into one end of the drum and the tumbling action results in logs hitting other logs, which loosens and removes the bark as the logs progress to the opposite end of the drum. The drum may have a plurality of bark slots, and the number and size of these openings vary with the size and species of wood to be debarked. The debarking slots are simply holes cut in the cylindrical wall of the drum shell. The drum may contain lifters which are steel or rubber members which extend radially inwardly of the inside surface of the drum and control or enhance the tumbling action of the logs. The tumbling action both loosens the bark and breaks it apart. The loose bark then falls through the bark slots.

A problem exists for certain types of logs such as hickory which have a thick stringy bark during certain times of the year. This bark will not easily move through standard size slots. If slots large enough to accommodate the bark are cut in the drum, useful wood fiber is lost as slivers which break from the logs, and smaller sticks containing useful fiber which pass through the over-large bark slots. What is needed is a drum debarker which allows removal of thick fiberous bark through openings in the drum but which retains smaller sticks and log slivers containing useful fiber.

SUMMARY OF THE INVENTION

The log debarker of this invention has a cylindrical steel drum which is mounted for rotation about the drum axis. Logs are fed into one end of the drum, and the tumbling action of the drum causes the bark to be removed. The debarked logs are then discharged from the other end of the drum. The cylindrical shell of the drum is penetrated by a multiplicity of slots at least some of which are larger than normal having a minimum width of 3½ inches, preferably six inches, and a length of about one to two feet. The slots are arrayed circumferentially about the drum and extend axially along the length of the drum. Each large slot has a cover which is mounted to the exterior of the drum and is spaced to form a minimum two inch gap between the exterior surface of the drum and the cover. The cover has a shallow U-shaped member with legs which are welded to the exterior of the drum adjacent the short sides of the slots. The U-shaped member extends about one to one-half inches on either side of the slot. The bottom of the U-shaped member is preferably flat so that the gap between the U-shaped member and the exterior surface of the drum increases in the circumferential direction away from the edge of the slot. The quantity and location of the bark slots are determined by drum size and log species and may be, for example, about 5 percent of the area defined by the exterior cylindrical surface of the drum. The covers prevent sticks and log pieces from leaving the drum with the bark. At the same time, bark slots which are approximately six inches wide can receive large thick fibrous bark which in the past has been difficult to separate from the logs by means of bark slots. Once a slab of bark begins to move through the slot, the tumbling action of the logs will tend to drive the bark through the slot, or break the slab of bark into smaller pieces which can then pass through the slots.

It is a feature of the present invention to provide a debarking drum which is effective at separating thick fibrous or stringy bark from logs.

It is another feature of the present invention to provide a debarking drum with a higher yield of useful fiber.

Further features and advantages of the invention will be apparent from the following detailed description when taken in conjunction with the accompanying drawings.

DESCRIPTION OF THE PREFERRED EMBODIMENTS

Figure 2:
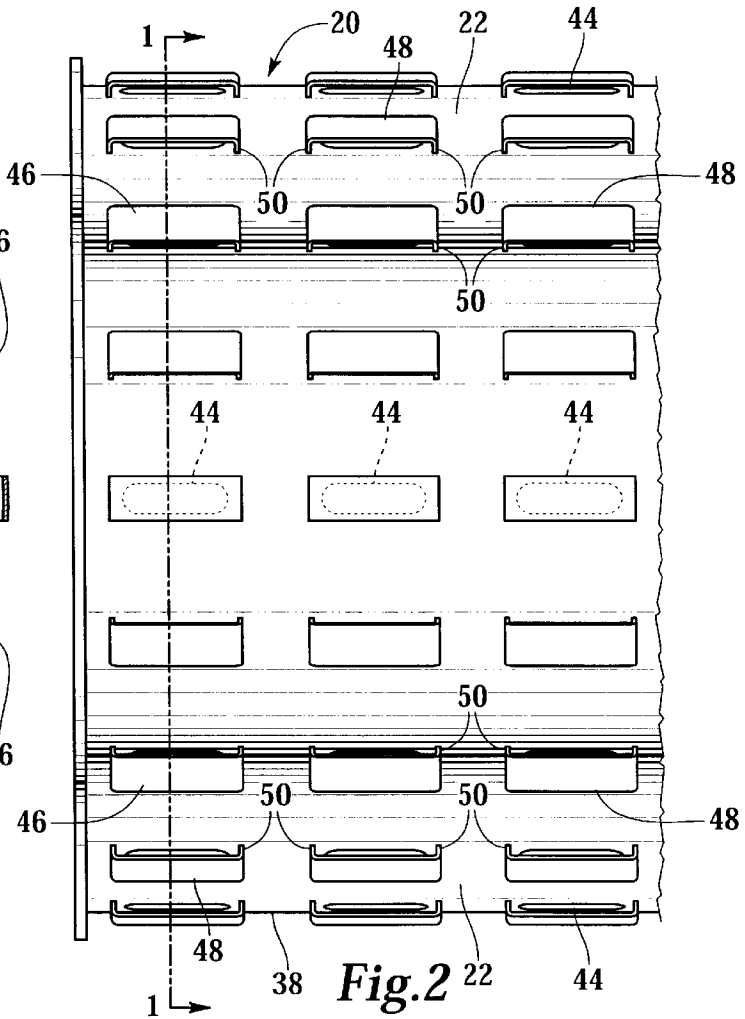
FIG. 2 is a fragmentary side elevational view of the debarking drum of FIG. 1.
Figure 1:
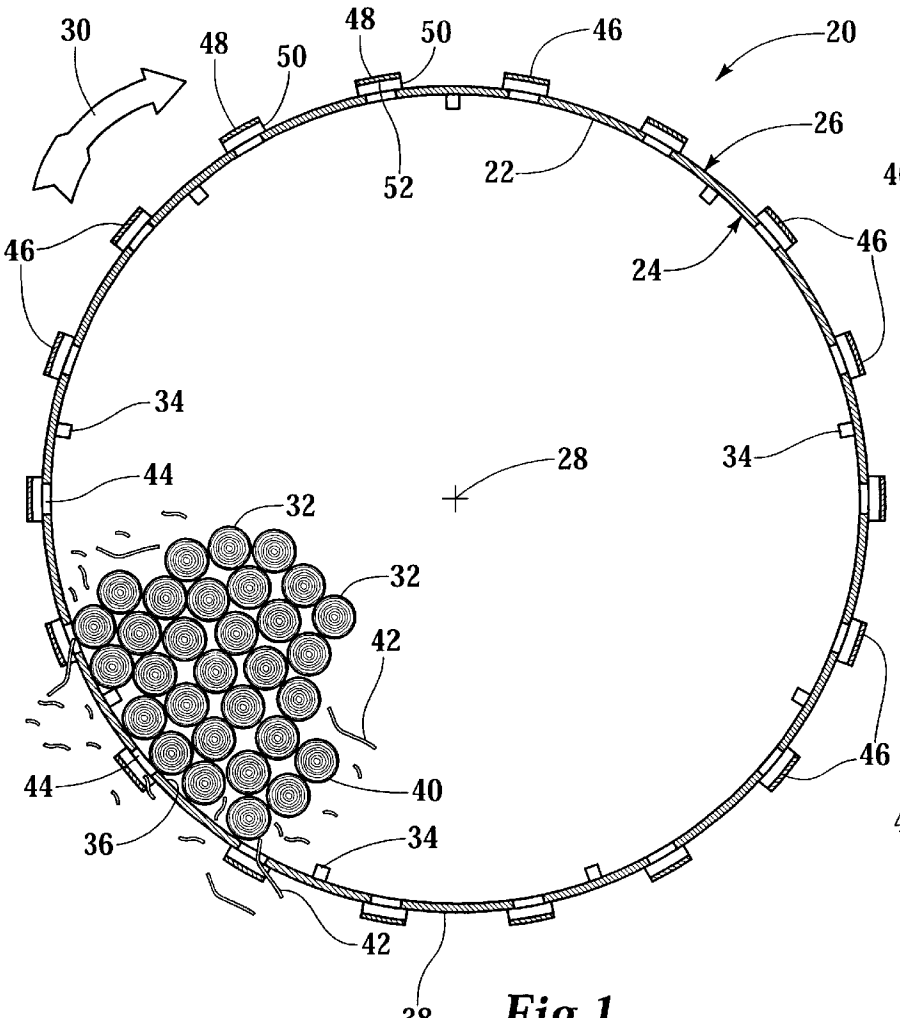
FIG. 1 is a cross sectional view of a debarking drum of this invention, taken along section line 1—1 in FIG. 2.
Figure 3:
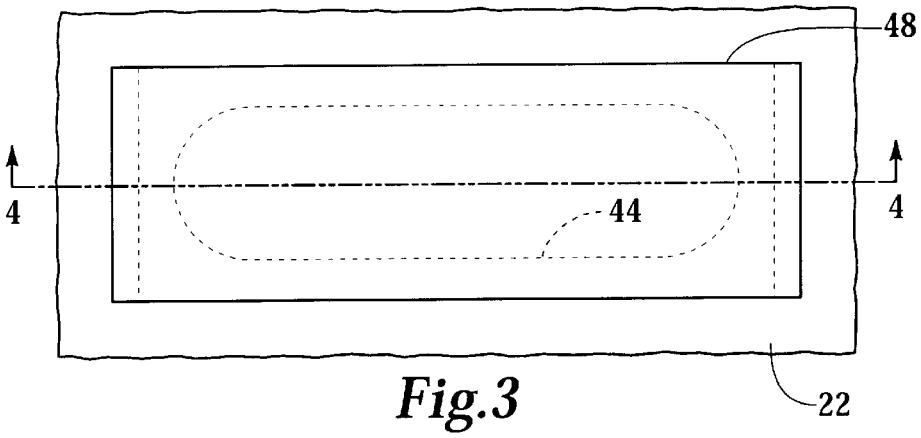
FIG. 3 is a fragmentary top plan view of a bark slot and cover of the debarking drum of FIG. 1.
Figure 4:
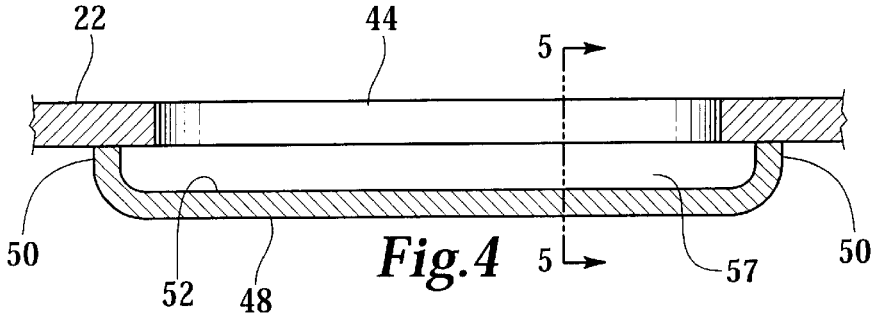
FIG. 4 is a cross sectional view of the bark slot of FIG. 3 taken along section line 4—4.
Figure 7:
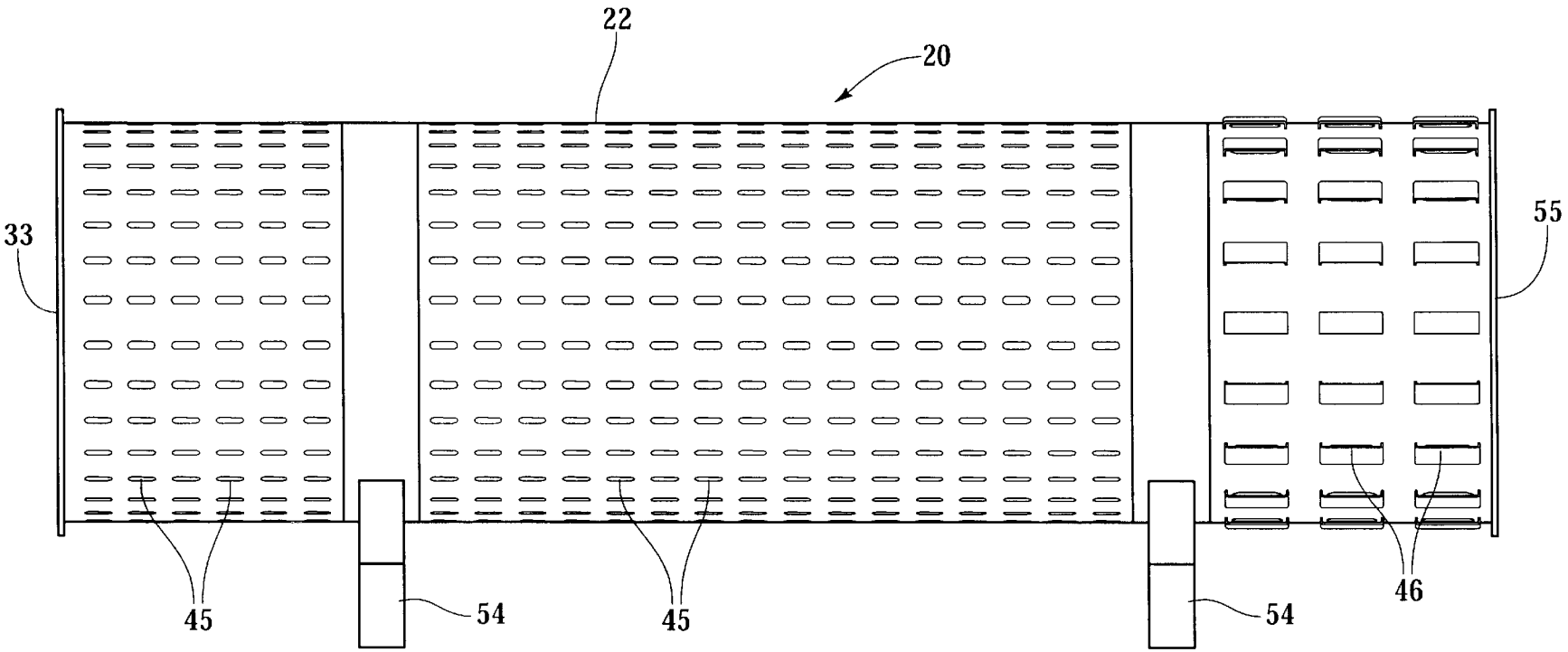
FIG. 7 is a side elevational view of the debarking drum of FIG. 1.

Referring more particularly to FIGS. 1–7 wherein like numbers refer to similar parts, a debarking drum 20 is shown in FIGS. 1–2 and 7. The debarking drum 20 has a cylindrical shell 22 with an interior cylindrical surface 24 and an exterior cylindrical surface 26. The cylindrical shell 22 defines an axis 28 about which the drum 20 rotates as indicated by arrow 30. The drum is mounted on trunnions or tires 54. Logs 32 are fed into an inlet 33 of the debarking drum 20 with the length of the logs extending roughly parallel to the axis 28 of the drum. Rotation of the drum 20 urges the logs contained therein along the interior wall. Movement of the logs is assisted by lifter 34 which may be steel or rubber bars. The movement of the drum, aided by the engagement of the lifters with the logs, causes the logs 32 to climb a portion 36 of the interior cylindrical surface 24 which is above the low point 38 of the drum in the direction of rotation. The logs 32 tumble down the wall 36 of the cylindrical drum in the direction opposite the direction of rotation of the drum and opposite the direction indicated by arrow 30. The tumbling action causes the logs to strike each other, which loosens bark 40 and breaks the bark into slabs and pieces 42 which separate from the logs 32.

Because it is desirable to separate the bark 40 from the logs 32 within the debarking drum 20, a multiplicity of slots 45 are cut in the cylindrical shell 22 which extend parallel to the direction of the axis 28. Two sizes of debarking slots may be employed, conventional narrow slots 45 which are exposed to the exterior of the drum, and several rings of oversize slots 44 from which bark is allowed to escape, but from which useful fiber is prevented from escaping by metal covers 46. The debarking drum 20 is designed to handle thick fibrous stringy bark such as hickory or eucalyptus which results in large pieces of bark which do not pass through the conventional debarking drum slots 45. Conventional size slots have a width of 1½ to 2¼ inches. Conventional slots do not pass all of the bark from certain trees such as hickory especially during certain seasons of the year when the bark is tougher. The debarking drum 20 handles thick fibrous bark by sizing some oversized bark slots 44 to be at least three-and-a-half inches wide and one to two feet in length, preferably 22 inches. Preferably, the bark slots 44 will be six inches wide.

Covers 46 extend over the bark slots 44 on the exterior 26 of the debarking drum 20 in order to prevent sticks 47 and log pieces which contain useful fiber from passing through the large bark slots 44. Typically, the last two or three rows as illustrated in FIGS. 2 and 7 will consist of the oversize bark slots 44 although additional rows of oversize bark slots 44 with covers 46 may be used as necessary. After treatment within the drum 20, the debarked logs are discharged from the drum through an outlet 55.

Figure 5:
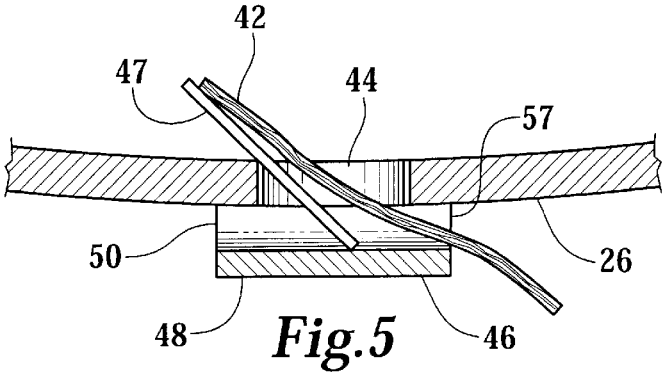
FIG. 5 is a cross sectional view of the bark slot of FIG. 4 taken along section line 5—5.
Figure 6:
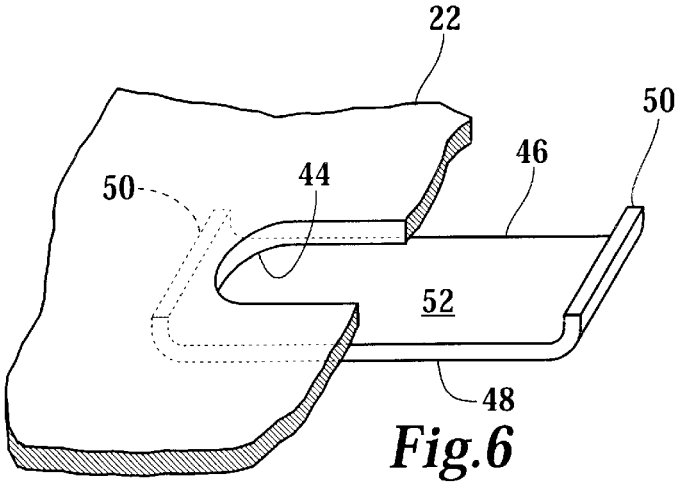
FIG. 6 is a fragmentary isometric view of a bark slot of the debarking drum of FIG. 1.

As shown in FIG. 5, the stiff wood sticks or fragments will not bend as they pass out of the slot, and will thus engage against the radially outwardly spaced cover 46. The stringy bark however, is often more flexible or thinner, and is thus capable of readily bending and escaping through the upstream and downstream gaps defined between the cover central section 48 and the exterior surface of the drum. The large slots 44 provide a larger opening to receive bark 42 at the same time the bark slot covers 46 define narrower lateral slots 57 between the exterior cylindrical surface 26 and the inside surface 52 of the slot cover 46. The height of the lateral slots 57 are defined by the short legs 50 and are at least two inches and preferably less than about 50 percent of the large slot width which are preferably six inches in width or slot width of 3½ inches the lateral slots 57 are proportionately wider but remain considerably less than the width of the slots. Thus the large slots 44 and the covers 46 create outlets from the drum bark outlets which have large slots 44 followed by narrower slots 57.

The covers 46, best shown in FIGS. 3–6, are shallow U-shaped members. Each U-shaped member has a long flat central portion 48 which faces the drum exterior surface 26 and is held spaced at least two inches from the exterior surface 26 by two short legs 50. The short legs 50 of the U-shaped members are welded to the exterior surface 26 of the debarking drum 20. The long flat central portions 48 of the covers 46 cover the debarking slots 44 and extend about one inch beyond the slots in all directions. The standoff between the drum exterior surface 26 and the inside surface 52 of the central portions 48 of the covers is at least two inches to allow large fibrous slabs of bark 42 to pass between the covers 46 and the exterior surface 26 of the debarking drum 20.

It should be understood that bark slots while often parallel to the axis of the debarking drum are at times angled with respect to the axis of the drum.

It is understood that the invention is not limited to the particular construction and arrangement of parts herein illustrated and described, but embraces all such modified forms thereof as come within the scope of the following claims.

We claim:

1. A debarking drum comprising:

a cylindrical shell mounted for rotation, having an interior cylindrical surface and an exterior cylindrical surface, the cylindrical shell defining an axis about which the cylindrical shell rotates, and the cylindrical shell defining a circumferential direction;

portions of the shell defining a multiplicity of first slots, wherein each first slot has a width of 1½ inches to 2¼ inches and a length of about 1 to about 2 feet;

portions of the shell defining a multiplicity of large second slots, each large second slot having a width of at least 3½ inches and a length of about 1 to about 2 feet; and a plurality of slot covers fixed to the shell, each slot cover being mounted radially outwardly of a large second slot, wherein each slot cover is a U-shaped member which extends over a large second slot to prevent sticks and log pieces which contain useful fiber from passing through said large second slot, and wherein each slot cover has a central portion which is spaced by two legs at least two inches from the exterior surface but not more than the width of the large second slot, the central portion being positioned to overlie said large second slot and to extend about one inch beyond the slots in the circumferential direction.

2. The debarking drum of claim 1 wherein each slot cover central portion is spaced by the two legs not more than 50 percent of the width of the large second slots.

3. The debarking drum of claim 1 wherein the shell has a first end into which logs are fed and an opposite second end from which logs are removed, and wherein the multiplicity of large second slots are positioned nearer the second end than the first end.

4. The debarking drum of claim 1 wherein the large second slots are at least six inches wide.

5. The debarking drum of claim 1 further comprising a plurality of lifters mounted to the drum interior to cause logs to climb a portion of the interior cylindrical surface which is above a low point of the drum in the direction of rotation.

6. A rotatable debarking drum comprising:

an axially extending cylindrical shell which extends from a log inlet to a log outlet, wherein a downstream direction is defined from the log inlet to the lox outlet, the cylindrical shell having an interior cylindrical surface and an exterior cylindrical surface, the cylindrical shell defining an axis about which the cylindrical shell rotates, and the cylindrical shell defining a circumferential direction;

portions of the shell which define a plurality of first slots which extend a first width in the circumferential direction of the shell;

portions of the shell which define a plurality of large second slots which extend a second width in the circumferential direction of the shell, the second width being greater than the first width and at least about 3½ inches; and a plurality of covers, wherein each cover has two legs which are fixed to the shell and which extend radially inwardly at least 2 inches, and a central segment which connects the two legs, the two legs being axially spaced from one another, and wherein the central segment fully overlies the large second slot over which it is mounted, and wherein a first gap is defined between the shell, the two legs, and the central segment upstream of the slot in the circumferential direction of the shell, and a second gap is defined between the shell, the two legs and the central segment downstream of the slot;

wherein the large second slots are positioned downstream of the first slots; and wherein the width of each cover along the circumferential direction of the shell is less than twice the width of the large second slot in the same direction.

7. The debarking drum of claim 5 wherein each cover is spaced from the exterior surface of the drum a distance that is less than the width of the large second slot in the circumferential direction of the shell.

8. The debarking drum of claim 5 wherein each cover is spaced from the exterior surface of the drum a distance that is less than one half the width of the large second slot in the circumferential direction of the shell.

9. A rotatable debarking drum comprising:

an axially extending cylindrical shell which extends from a log inlet to a log outlet, the cylindrical shell having an interior cylindrical surface and an exterior cylindrical surface, the cylindrical shell defining an axis about which the cylindrical shell rotates;

portions of the shell which define a plurality of first slots which extend a first width at least substantially in the circumferential direction of the shell at least 3½ inches, and extending at least substantially in an axial direction a length between about one and about two feet;

each of the plurality of first slot,s having a cover fixed to the shell and are spaced radially outwardly at least 2 inches from the exterior surface, and having a central segment which fully overlies the first slot over which it is mounted, and wherein a first gap is defined between the shell, and the central segment upstream of each first slot in the circumferential direction of the shell, and a second gap is defined between the shell, the central segment downstream of each first slot, and wherein the first gap and the second gap have a height formed between the exterior cylindrical surface and the central segment which is less than the first width.

10. The debarking drum of claim 9 wherein the the first gap and the second gap have a height formed between the exterior cylindrical surface and the central segment which is less than about 50 percent of the first width.

11. The debarking drum of claim 9 further comprising portions of the shell which define a second plurality of slots which extend a second width at least substantially in the circumferential direction of the shell no more than 2½ inches, and extend at least substantially in the axial direction a length between about one and about two feet.

12. The debarking drum of claim 11 wherein the plurality of first slots and the second plurality of slots are arranged along the drum so that the log inlet is followed in the axial direction by the second plurality of slots, followed in the axial direction by the plurality of first slots, followed by the log outlet.

* * * * *

UNITED STATES PATENT AND TRADEMARK OFFICE

CERTIFICATE OF CORRECTION

PATENT NO. : 6,752,185 B1
DATED : June 22, 2004
INVENTOR(S) : Blaylock et al.

It is certified that error appears in the above-identified patent and that said Letters Patent is hereby corrected as shown below:

Column 4,
Line 59, “lox” should be -- log --

Column 6,
Line “slot,s” should be -- slots --
Line 7, “and are spaced” should be -- and spaced --

Signed and Sealed this

Third Day of August, 2004

JON W. DUDAS
*Acting Director of the United States Patent and Trademark Office*